United States Patent [19]

Seidel

[11] 4,115,905

[45] Sep. 26, 1978

[54] FASTENER FOR SHOES

[75] Inventor: Sigurd Seidel, Graz, Austria

[73] Assignee: Skischuhfabrik Dynafit Gesellschaft m.b.H., Graz, Austria

[21] Appl. No.: 799,232

[22] Filed: May 23, 1977

[51] Int. Cl.[2] ..... A43C 11/14

[52] U.S. Cl. ..... 24/69 SK; 24/70 SK; 36/50

[58] Field of Search ..... 24/68 SK, 69 SK, 70 SK, 24/71 SK, 73 SG, 81 SK; 36/117, 118, 119, 120, 50

[56] References Cited

U.S. PATENT DOCUMENTS

| | | | |
|---|---|---|---|
| 3,333,301 | 8/1967 | Lubian | 24/70 SK |
| 3,546,751 | 12/1970 | Baso | 24/70 SK |
| 3,654,670 | 4/1972 | Baso | 24/70 SK |
| 3,683,460 | 8/1972 | Baso | 24/70 SK |

*Primary Examiner*—Louis K. Rimrodt
*Attorney, Agent, or Firm*—Fleit & Jacobson

[57] ABSTRACT

A retaining plate has at least two succeeding female detent means for receiving one end of a strap, which is received and retained at its other end in female detent means of a buckle. The female detent means in the retaining plate are covered by a cap, which consists of extensible material and is provided at opposite ends with pockets, which are fitted around raised edge portions of the retaining plate so that the cap is under initial tension.

4 Claims, 2 Drawing Figures

FASTENER FOR SHOES

SUMMARY OF THE INVENTION

A cap of extensible material is provided at opposite ends with pockets fitted around raised edge portions of a retaining plate, so that the cap is under initial tension. The retaining plate is formed with at least two female detent means, in which one end of a preferably curved strap is received and retained. The other end of the strap is received and retained in female detent means of a buckle.

This invention relates to a fastener for shoes, particularly for sport shoes, comprising a strap, a buckle formed with female detent means for receiving one end of said strap, a retaining plate having at least two successive female detent means, which are adapted to releasably receive the other end of the strap, and a covering member for covering the latter detent means. The fastener provided with a tightening lever is mainly used in skiing boots.

It is an object of the invention to provide means which facilitate the adjustment of the strap whereas a reliable locking of said strap in position for use is ensured.

Particularly skiing boots are required to properly fit the foot so that a reliable and exact control of the ski is enabled. To ensure such fit, the fastener of the shoe must be firmly tightened although the shoe will then apply painful pressure to the foot when the wearer is walking or driving a car. To eliminate this disadvantage, skiing boots consisting of an inner shoe and an outer shoe have been used and the fastener of the outer shoe has been opened when the wearer has been walking or driving a car. The fastener has been tightened only when the boot was about to be applied or had been applied to a ski. On the other hand, when the fastener is open, its loose parts may strike obstacles and the fit of the foot in the boot is too loose for a proper walking. Whereas adjusting means have been provided in an attempt to eliminate this disadvantage, it is difficult to actuate these adjusting means outdoors with hands covered by gloves.

The Swiss Patent Specification No. 519,312 disclosed a fastener, which comprises a tightening lever and in which the female detent means of the retaining plate are covered by an elastically yieldable part, which may consist of a leaf spring or be constituted by the upper part of the boot. Whereas such covering parts are flexible so that they can yield when the strap is to be moved out of one female detent means into another, they are not extensible and have disadvantages. In shoes of plastics material, the upper cannot be used as covering means because such upper is almost rigid. The leaf spring can be connected to the shoe only with difficulty and may break.

To accomplish the object set forth hereinbefore while avoiding the above-mentioned disadvantages of the known fasteners, the invention provides a shoe fastener which is of the kind defined first hereinbefore and in which, in accordance with the invention, the covering means consist of a cap, which consists of extensible material and is provided at opposite ends with pockets, which are fitted around raised edge portions of the retaining plate so that the cap is under initial tension.

In this fastener, the strap can easily be moved out of one female detent means into another if the resistance of the extensible cap is overcome, but the cap reliably prevents an unintended movement of the strap from its position for use.

Further details of the invention will be explained more fully with reference to the drawing, in which a skiing boot is shown which is provided with a fastener embodying the invention.

Figure 1:
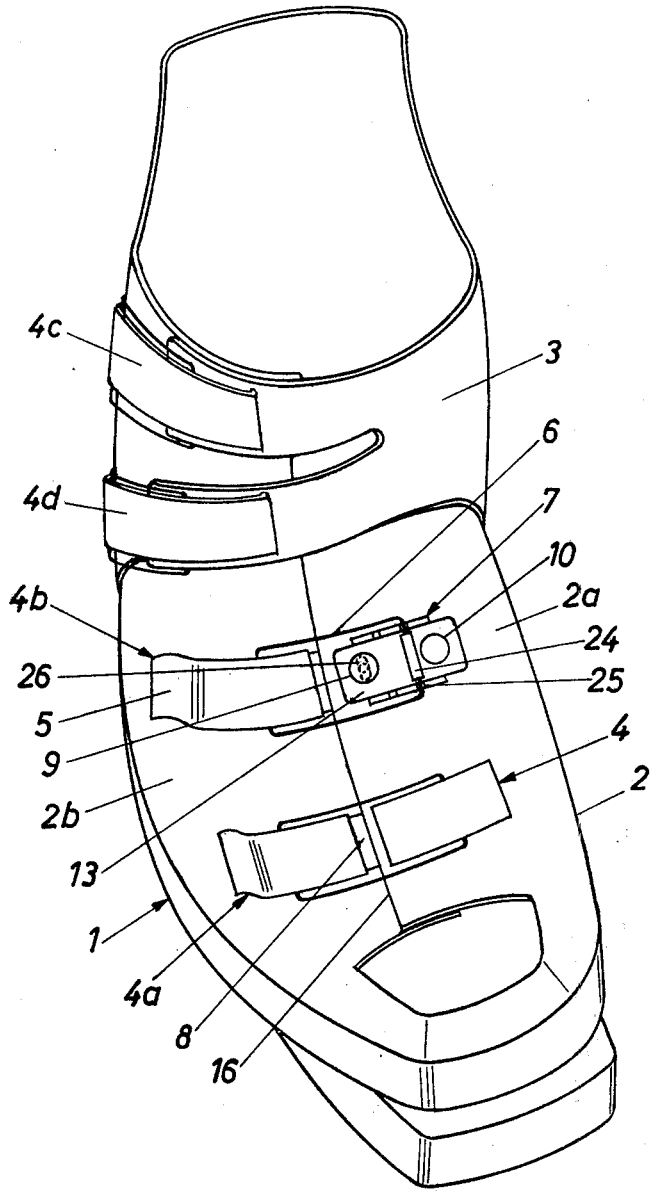
FIG. 1 is a perspective view showing the skiing boot, which is provided with four fasteners, one of which is shown without the resilient cap.
Figure 2:
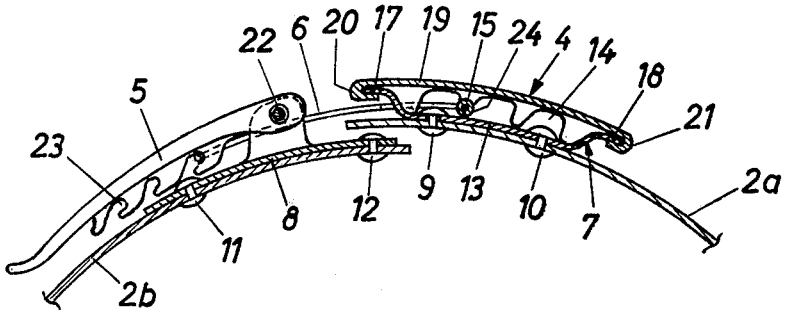
FIG. 2 is a longitudinal sectional view showing the fastener that has been removed from the boot.

The skiing boot 1 comprises an upper 2 and an ankle gaiter 3, which is pivoted or hinged to the upper 2. The upper 2 comprises two parts 2*a* 2*b*, which overlap over the instep and are connected to each other by two fasteners 4*a*, 4*b*. Two additional fasteners 4*c*, 4*d* serve to connect the overlapping parts of the ankle gaiter. Because all four fasteners are identical and the boot itself is no part of the invention, the fastener is designated 4, for the sake of simplicity, and will be explained with reference to FIG. 2 and the fastener 4*b* in FIG. 1.

The shoe fastener comprises a carrying plate 8, a buckle 5, which is pivotally connected to the carrying plate by a pivot 22, and a curved strap 6, which is adapted to interlock with the buckle 5 and with a second carrying plate 13. The carrying plates 13 and 9 are secured to respective parts 2*a* and 2*b* of the shaft by respective pairs of rivets 9, 10 and 11, 12. The carrying plate 13 has upturned longitudinal edge portions 14, which are formed with female detent means 15 consisting of pairs of aligned recesses 15, which constitute female detent elements and are open upwardly and outwardly with respect to the overlapping edge portion 16 of the associated part 2*a* of the shaft so that tension applied to the strap 6 will cause the same to be forced against the bottom of the recesses 15. The edge portions 7 at the ends of the carrying plate 13 are upwardly offset and their terminal portions 17, 18 extend parallel to the carrying plate 13. A cap 19 of extensible material is formed at opposite ends with pockets 20, 21, which are fitted around the terminal portions 17, 18, respectively.

The cap 19 is extensible to such an extent that it can be fitted over and around the terminal portions 17, 18 and then covers the carrying plate 13, inclusive of its edge Portions 14 and recesses 15. The cap yields when the buckle 5 is to be shifted from one pair of recesses 15 to another. On the other hand, an effort or tool is required to pull the cap from the terminal portions 17, 18.

The buckle 5 is pivoted on the pin 22 at that end of the buckle which faces the overlapping edge portion 16 and is provided on its underside with pairs of detent recesses 23, which are open in an outward and downward direction, generally opposite to the detent recesses 15. As a result, tension applied to the strap 6 will cause the buckle to be forced against the carrying plate 8.

That portion 25 of the strap 6 which is retained in the recesses 15 is provided with a roller 24, which ensures that a shifting of the strap 6 from one pair of detent recesses 15 to another will not be resisted by friction between the portion 25 and the cap 19.

Because in a boot which has yieldable uppers 2*a*, 2*b* having a curved configuration, the directions in which the operative pairs of detent recesses 15, 23 are aligned may not be exactly parallel to each other in all possible positions of the strap 6, a shifting of the latter from one position to another might involve a canting of the strap or the application of an eccentric tension thereto. To avoid this, that rivet 9 of the carrying plate 13 which is nearer to the overlapping edge portion 16 is preferably guided in a slot 26, which is formed in the carrying plate 13 and which is substantially parallel to the portion 25 of the strap 6. As a result, the carrying plate 13 can perform an angular movement during a shifting of the strap 6. Whereas this angular movement is only slight, it is sufficient to ensure that the pairs of recesses 15 and 23 engaged by the strap 6 before and after said shifting will be aligned in directions which are parallel to each other.

When a skier who wears boots provided with fasteners according to the invention has opened the buckle 5 and has slightly raised the strap 6 in the detent recesses 15, he can shift the fastener to provide a tighter fit of the foot in the boot for skiing or a looser fit for walking.

What is claimed is:

1. A fastener for a shoe, particularly for a sports shoe, comprising a strap having connection means at each end for connecting the strap, a buckle formed with female detent means for receiving and retaining the connection means of one end of the strap, a retaining plate having at least two succeeding female detent means for releasably receiving the connection means of the other end of the strap, and covering means for covering the female detent means in the retaining plate, the covering means having a cap formed of extensible material formed with pockets at opposite ends, the retaining plate having raised edge portions for receiving the pockets in such manner that the cap is under initial stress.

2. A fastener as set forth in claim 1, wherein the connection means of the strap received by the female detent means of the retaining plate comprises a roller and wherein the retaining plate has upturned side edges forming the female detent means of the retaining plate.

3. A fastener as set forth in claim 1, wherein the retaining plate has an end which faces the strap and said end is formed with a slot, which extends transversely to the longitudinal direction of the strap and is adapted to receive fixing means for fixing the retaining plate to a shoe in such manner that the end with the slot can move with respect to the shoe.

4. A fastener as set forth in claim 2, wherein said cap covers said upturned side edges of said retaining plate.

* * * * *